United States Patent [19]

Grinblat

[11] Patent Number: 4,709,918

[45] Date of Patent: Dec. 1, 1987

[54] UNIVERSAL EXERCISING APPARATUS

[76] Inventor: Arkady Grinblat, 52 Fairfax St., Somerville, Mass. 02144

[21] Appl. No.: 946,910

[22] Filed: Dec. 29, 1986

[51] Int. Cl.[4] ..... A63B 69/18; A63B 21/04

[52] U.S. Cl. ..... 272/97; 272/70; 272/72; 272/134; 272/DIG. 4

[58] Field of Search ..... 272/70, 72, 97, 116, 272/131-134, 140, 144, DIG. 4; 128/25 R

[56] References Cited

U.S. PATENT DOCUMENTS

| | | | |
|---|---|---|---|
| 1,982,843 | 12/1934 | Traver | 272/72 |
| 3,586,322 | 6/1971 | Kverneland | 272/72 |
| 3,770,267 | 11/1973 | McCarthy | 272/72 X |
| 4,023,795 | 5/1977 | Pauls | 272/97 |
| 4,477,071 | 10/1984 | Brown et al. | 272/72 |
| 4,512,571 | 4/1985 | Hermelin | 272/70 X |
| 4,556,216 | 12/1985 | Pitkanen | 272/134 X |
| 4,620,701 | 11/1986 | Mojden | 272/144 X |
| 4,621,623 | 11/1986 | Wang | 272/72 |
| 4,627,610 | 12/1986 | Ishida et al. | 272/134 X |
| 4,627,614 | 12/1986 | DeAngeli | 272/134 X |
| 4,640,268 | 2/1987 | Roberts | 128/25 R |
| 4,659,077 | 4/1987 | Stropkay | 272/70 X |

FOREIGN PATENT DOCUMENTS

| | | | |
|---|---|---|---|
| 2511879 | 3/1982 | France | 272/72 |
| 2156693 | 10/1985 | United Kingdom | 272/116 |

OTHER PUBLICATIONS

Advertisement for "Cross-Country Shortcut" in the Washington Post, 3/1980.

Brochure for "Body Shop 360" by Weslo International, 2/1984.

Brochure for "Octa-Gym" by Ajay Fun & Fitness, 1984.

Nordic Track Brochure, 1983.

*Primary Examiner*—Richard J. Apley
*Assistant Examiner*—Robert W. Bahr
*Attorney, Agent, or Firm*—Jacox & Meckstroth

[57] ABSTRACT

An elongated base frame forms generally horizontal parallel tracks which support a pair of foot support platforms and carriages for independent longitudinal movement. A vertical column has a releasable pivot connection to one end of the base frame and supports a pair of arms for 360° rotational movement as a unit on a horizontal axis. Each arm is also supported for pivotal movement through an angle of about 90° on an axis normal to the horizontal axis, and retractable stops provide for selecting different rotational and angular positions of the arms. A spring retractable cable reel is mounted on each arm, and a flexible cable extends from each reel around a swivel pulley on the outer end of the arm to a handle grip having a V-shaped configuration. Each of the foot support carriages has an adjustable sliding brake, and each cable reel is connected to an adjustable disk brake through a one-way clutch. The foot support carriages may be coupled together with a seat platform, and a resilient pad is supported by the column in selectable different positions.

20 Claims, 17 Drawing Figures

UNIVERSAL EXERCISING APPARATUS

BACKGROUND OF THE INVENTION

In the art of exercising apparatus or machines, there have been many different types of machines either proposed or developed for providing various body exercising movements in opposition to a resistance. Usually the resistance is provided by a set of springs or fluid cylinders or by mechanisms which provide for resisting the movement of one body member with the movement of another body member. For example, U.S. Pat. Nos. 1,982,843, 3,586,322, 3,770,267, 4,023,795, 4,477,071 and 4,512,571 disclose a variety of such exercising machines or apparatus. Also, a simulated cross-country ski exerciser similar to that disclosed in U.S. Pat. No. 4,023,795 is combined with an arm exerciser in the form of a reciprocating cable extending around a pulley, and the exerciser is sold under the trademark "NordicTrack".

SUMMARY OF THE INVENTION

The present invention is directed to an improved exercising machine or apparatus which has substantial adjustability and versatility in order to obtain more complete exercise for the human body. The exercising apparatus of the invention is convertible so that it may be used not only as a simulated cross-country ski exerciser but also as a rowing machine in addition to other exercising machines for other muscle groups of the body. In addition, the exercising apparatus of the invention is simple and economical in construction and is easily collapsible to a compact space to simplify storage and shipping.

In accordance with one embodiment of the invention, the above advantages and features are provided by a machine or apparatus which includes an elongated base member or frame adapted to rest on the floor at a slight inclined. The base frame forms a pair of laterally projecting channels or tracks which receive a corresponding pair of foot platform support carriages. Each of the carriages is supported for longitudinal movement by a set of rollers within the track and has a friction brake which is adjustable for either clamping the carriage to the track or for changing the force required to move the carriage along the track. The independent foot support carriages may also be coupled together by a cushion seat platform for using the apparatus as a rowing machine or for performing other various exercises in a seated position.

One end of the base frame supports a vertical column, and the upper end portion of the column supports a pair of arms which may be rotated as a unit on a horizontal axis or independently pivoted on parallel axes extending transversely to the horizontal axis. Each of the arms carry a spring retractable cable reel connected by a one-way clutch to an adjustable disk brake. The cable from each reel extends around a swivel pulley mounted on the outer end of each arm, and the free end of the cable is connected to a V-shaped handle grip. A resilient pad may be attached to the column by a quick-release and vertically adjustable clamping bracket, and the pad may also be supported in an upper position by a column extender attached to the column, depending upon the exercise desired.

Other features and advantages of the invention will be apparent from the following description, the accompanying drawings and the appended claims.

DESCRIPTION OF THE PREFERRED EMBODIMENT

Figure 1:
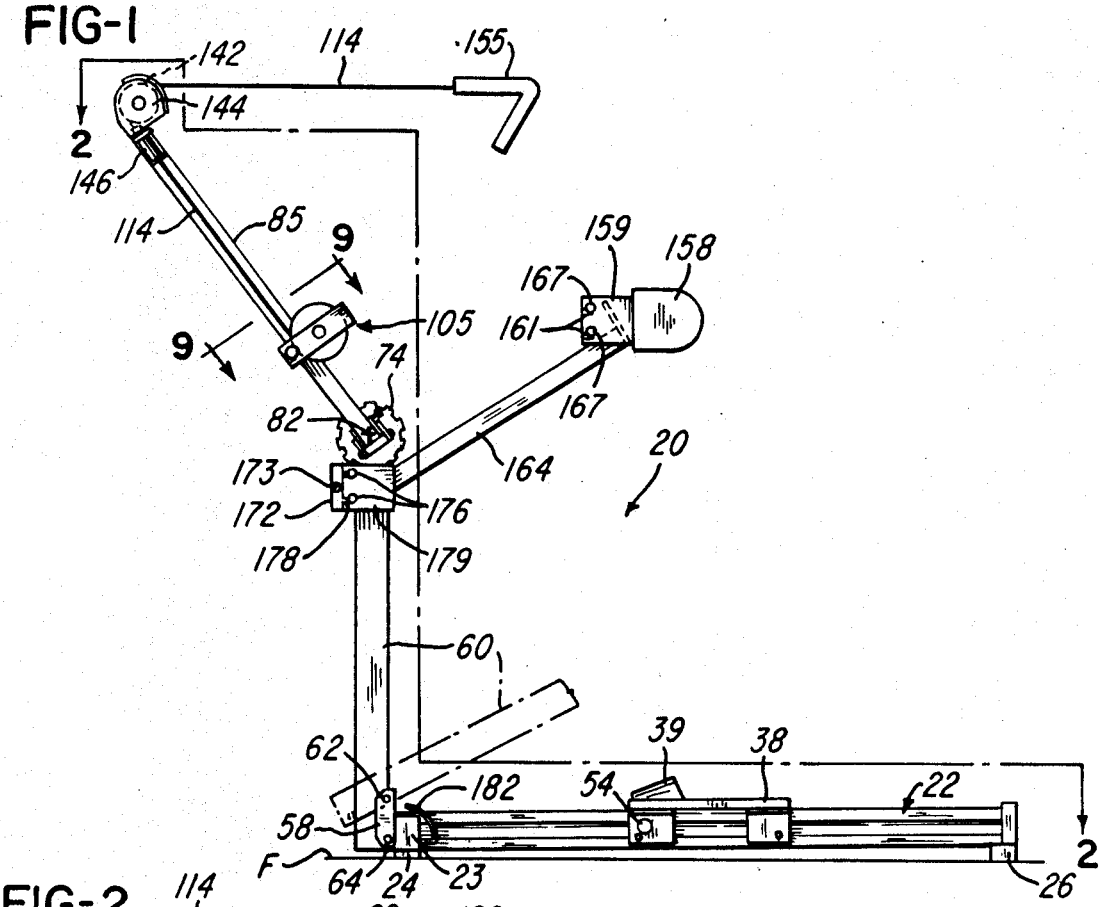
FIG. 1 is an elevational view of an exercising apparatus constructed in accordance with the invention and showing the apparatus arrange for a simulated cross-country skiing exercise.
Figure 8:
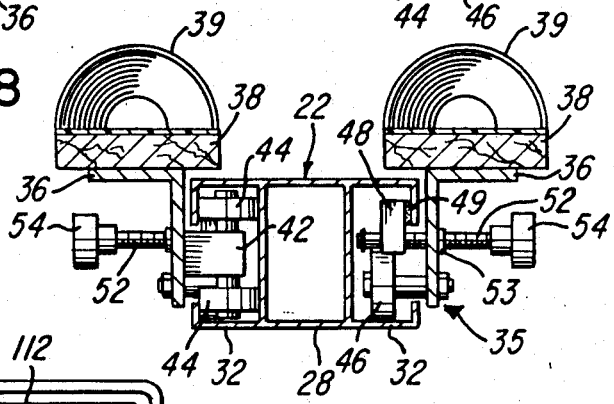
FIG. 8 is a section of the base frame and one foot support carriage, as taken generally on the line 8—8 of FIG. 2.

FIG. 1 shows an exercising machine or apparatus 20 which includes an elongated base member or frame 22 supported on one end by a cross tube member 23 with bottom pads 24 and on the other end by a pad 26. The pad 26 is somewhat higher than the pads 24 to provide the base frame 22 with a slight incline relative to a horizontal floor F. As shown in FIG. 8, the base frame 22 is preferably extruded from aluminum and includes a hollow center portion 28 connecting a pair of laterally projecting channel portions forming longitudinally extending rails or tracks 32.

Figure 7:
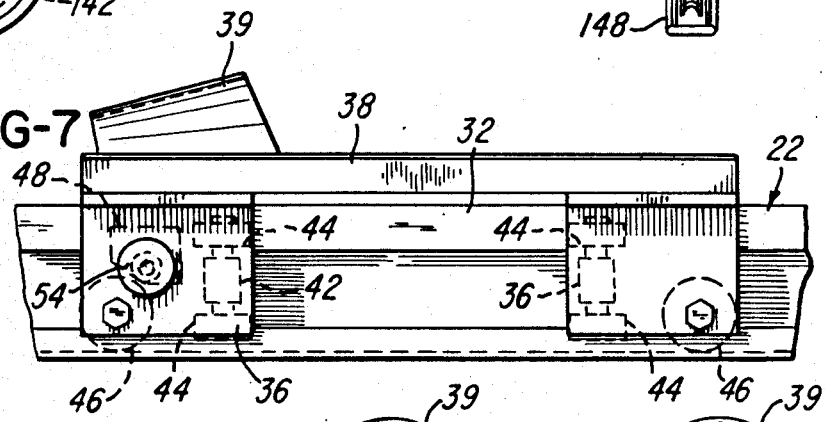
FIG. 7 is an enlarged elevational view of a foot support carriage as taken generally on the line 7—7 of FIG. 2.

Each of the channel portions or tracks 32 supports a foot support carriage 35 which includes a pair of longitudinally spaced inverted L-shaped angle brackets 36 rigidly connected by a wood foot support platform 38. A toe retainer or foot holder 39 is secured to the forward end portion of each platform 38 and is preferably formed of a flexible foot-conforming material. A block 42 (FIG. 8) is secured to each of the brackets 36 and supports a pair of anti-friction bearing or wheels 44 for rotation on vertical axis within the corresponding track 32. Each of the four support brackets 36 also carries an anti-friction support bearing or wheel 46 (FIG. 7) which rides on the bottom wall of the corresponding track 32.

Each of the foot support carriages 36 also includes an adjustable brake member or block 48 which carries a friction brake pad 49 for engaging the upper lip portion of the corresponding track 32. The block 48 is carried by the inner end portion of a screw 52 having left hand threads engaging a threaded bushing 53 within the forward support bracket 36. A knob 54 is secured to the outer end portion of the screw 52 to provide for conveniently adjusting the pressure exerted by the brake pad 49 against the corresponding track 32 for selecting or changing the force required to move the carriage 35 along the corresponding track 32 or for locking or clamping the carriage to the track.

Figure 5:
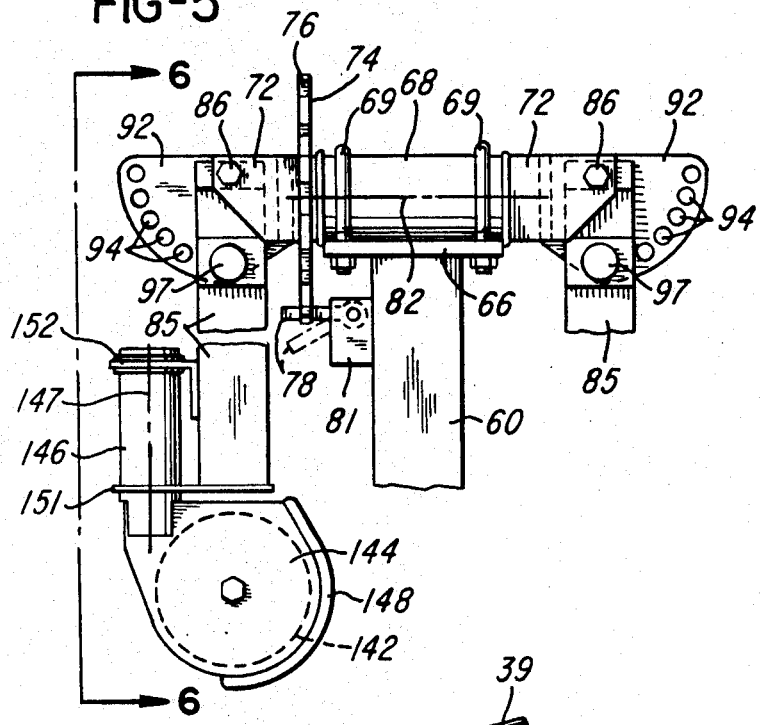
FIG. 5 is an enlarged fragmentary view taken generally on the line 5—5 of FIG. 4 and including an end portion of one arm.

A U-shaped bracket 58 (FIG. 1) is secured to the cross support member 23 of the base frame 22 and support a vertical post or column 60 having a rectangular cross-sectional configuration. A pivot pin 62 connects the column 60 to the bracket 58 and provides for pivoting the column to a generally horizontal collapsed position above the base frame 22 and between the foot support platforms 38. A removable cross pin 64 locks the column 60 after it is pivoted to its vertical position shown in FIG. 1. Preferably, the column 60 is formed from a section of an aluminum extrusion, and a plate 66 (FIG. 5) is secured or welded to the upper end of the column 60. The plate 66 supports a rotatable shaft 68 which is retained by a pair of U-bolts 69 and rest on a set of V-blocks (not shown) secured to the plate 66.

Figure 6:
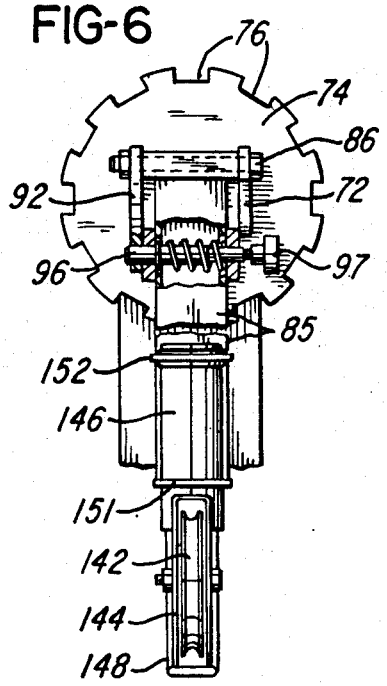
FIG. 6 is a fragmentary view taken generally on the line 6—6 of FIG. 5.

A pair of U-shaped brackets 62 are rigidly secured to opposite ends of the rotatable shaft 68, and a circular disk 74 is also secured to the shaft 68 adjacent one of the brackets 72. The disk 74 has peripherally spaced notches 76 (FIG. 6) which selectively receive a locking level or pawl 78 pivotally supported by a block 81 secured to the adjacent side of the column 60. The pawl 78 is normally biased upwardly into locking engagement with the disk 74 by a spring (not shown) retained within the block 81. Thus the shaft 68 and the brackets 72 may be rotated through 360 degrees on a horizontal axis 82 and selectively positioned at increments of about 30 degrees, which is the spacing between adjacent notches 76.

A pair of elongated arms 85 (FIGS. 1 & 2) have parallel end plates pivotally connected to the brackets 72 by corresponding pivot pins or bolts 86, and each arm is preferably formed from a section of an extruded square aluminum tubing. Each bracket 72 includes a sector plate 92 (FIGS. 5 and 6) which has a series of holes 94 spaced at angles or intervals of 15 degrees relative to the axis of the corresponding pivot pin 86. The end plates of each of the arms 85 carry a spring biased locking pin 96 (FIG. 6) for selectively engaging one of the holes 94 of the corresponding sector plate 92. A knob 97 on each pin 96 provides for retracting the pin from a selected hole 94 when it is desired to pivot the arm 85 on its pivot pin 86. Thus each arm 85 may be pivoted through an angle of about 90 degrees and selectively positioned at angular increments of 15 degrees according to the location of the holes 94.

A cable reel assembly 105 (FIG. 9) is carried by each of the arms 85 and includes a rectangular sheet metal frame 106 secured to the arm by a pair of bolts 108 extending through a retainer clamping plate 109. The frame 106 of each assembly 105 supports a spool-like reel 112 on which is wound or wrapped a flexible line or cable 114 having an inner end portion (not shown) secured to the reel. The reel 112 is supported for rotation by a stationary axle 116, and a clock-type coil spring (not shown) is enclosed within the reel 112 for connecting the reel to the axle 116 to provide for a spring retraction of the cable 114. The spring retractable cable reel 112 is similar to the reel commonly used for supporting a portable tool within a manufacturing plant.

Figure 9:
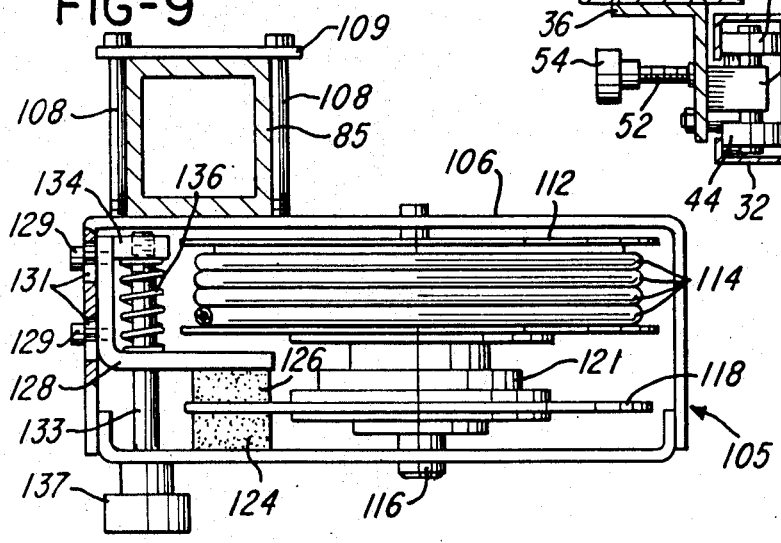
FIG. 9 is an enlarged view of an arm supported cable reel, as taken generally on the line 9—9 of FIG. 1.

The reel 112 of each assembly 105 is also connected to a circular brake disk 118 through a one-way clutch 121 constructed similarly to the one-way clutch used on the axle of rear bicycle wheel. The brake disk 118 rotates with the reel 112 when the cable 114 is extended, but the reel 112 is free to rotate relative to the disk 118 when the reel rotates in the opposite direction in response to the torque of the coil spring when the cable is retracted. As shown in FIG. 9, the brake disk 118 of each reel assembly 105 is positioned between a set of friction brake pads 124 and 126. The pad 124 is secured or bonded to the frame 106, and the pad 126 is carried by an L-shaped bracket 128 slidably supported by the frame 106 by a set of screws 129 extending through corresponding slots 131 within the frame 106. A screw 133 is rotatably supported by the frame 106 and the bracket 128 and threadably engages a nut 134 restrained from rotation by the bracket 128. A compression spring 136 between the bracket 128 and nut 134, and a knob 137 provides for rotating the screw 133 to adjust the compression spring 136 for adjusting the friction pressure applied by the brake pads 124 and 126 against the brake disk 118.

Referring again to FIG. 1, the cable 114 of each reel assembly 105 is directed outwardly parallel to the corresponding arm 85 and extends around a pulley 142 supported for swivel movment by the outer end of the corresponding arm 85. Each of the pulleys 142 is disposed within a U-shaped bracket 144 (FIG. 5) mounted on a tubular shaft 146 supported for rotation on an axis 147 by an end plate 151 and an L-shaped bracket 152. A wire retainer 148 confines the cable 114 on the pulley. The free end of each cable 114 is secured to a V-shaped handle grip 155 (FIG. 1). Each leg of each handle grip 155 is adapted to be selectively gripped by a hand, depending upon the exercise being performed on the apparatus.

As shown in FIG. 1, a resilient pad 158 is mounted on a U-shaped bracket 159, and each side of the bracket 159 has a pair of bayonet slots 161. For a simulated cross-country skiing exercise, the pad 158 is supported as shown in FIG. 1 by a column extender 164. The extender 164 has an upper end portion projecting into the bracket 159 and supporting a set of four knob rotated screws 167 which receive the corresponding slots 161 within the bracket 159.

Figure 4:
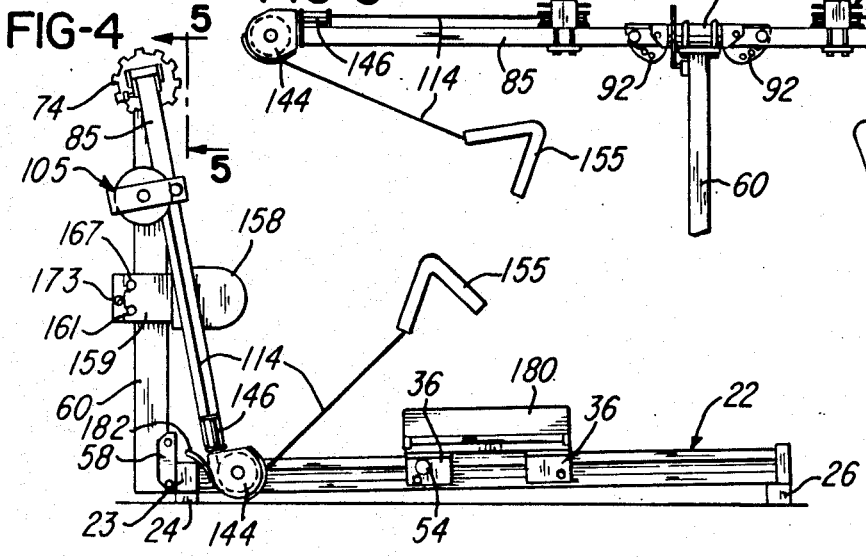
FIG. 4 is an elevational view of the exercising apparatus when converted to simulate a rowing machine.

A U-shaped slide bracket 172 (FIG. 1) is mounted on the column 60 for vertical sliding movement and is clamped at a selected position on the column by a knob rotatable screw 173. The slide bracket 172 carries a set of four knob rotatable screws 176 which receive corresponding bayonet slots 178 within a U-shaped bracket 179 constructed similar to the bracket 159 and secured to the lower end portion of the column extender 164. As shown in FIG. 4, when the screws 167 and 176 are released, the pad 158 may be quickly disconnected from the column extender 164 which, in turn, may be quickly disconnected from the slide bracket 172. The pad 158 and its support bracket 159 may then be attached to the slide bracket 172 to position the pad 158 adjacent the column 60. By releasing the screw 173, slide bracket 172 may be adjusted vertically on the column 60 according to the desired position of the pad 158 for performing various exercises.

Figure 2:
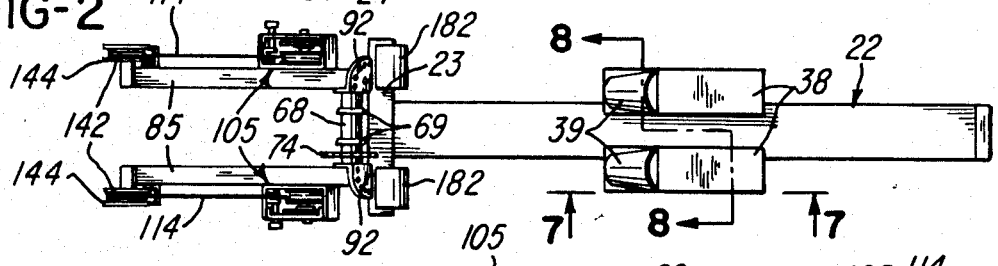
FIG. 2 is a partial plan view of the apparatus, as taken generally on the line 2—2 of FIG. 1.
Figure 3:
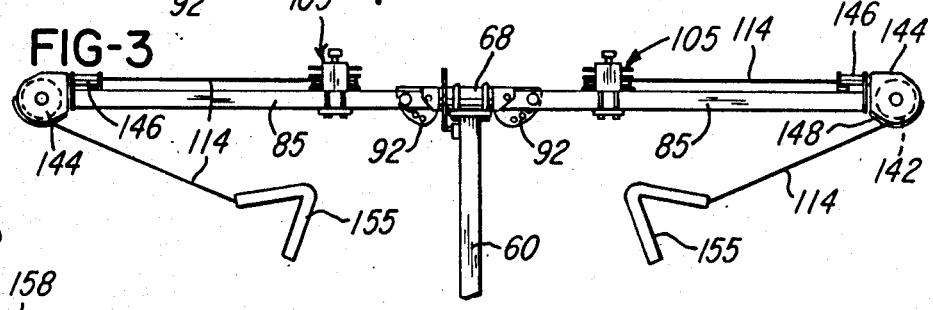
FIG. 3 is a fragmentary elevational view of the apparatus shown in FIG. 1 and with the arms extended to a horizontal position.

As also shown in FIG. 4, a cushion seat member or platform 180 is constructed to mount on the foot platforms 38 and to connect the foot platforms together for movement as a unit or to be clamped as a unit to the base frame 22. A pair of foot rests 182 are secured to the cross support member 23, as shown in FIGS. 1 and 2.

As illustrated by the diagrammatic representations of the exercising apparatus of the invention and the stick figures shown in FIGS. 10–17, the apparatus may be used for a variety of differnt exercises. For example, when the apparatus is positioned as shown in FIG. 1, the apparatus may be used as a simulated cross-country ski exerciser. When a person is standing on the foot support platforms 38, the person's waist engages the pad 158, and the person's hands grip the inner portions of the handle grips 155. The brake adjusting knobs 54 on the foot support carriages 35 are rotatably adjusted to select the desired frictional resistance to reciprocating movement of the carriages 35. The brake adjustment knobs 137 on the reel assemblies 105 are adjusted to provide the desired resistance to extension of the cables 114 from the reels 112. When each handle grip 155 is moved forwardly during the skiing exercise, the cable 114 is retracted onto the corresponding reel 122 while the brake disk 118 remains stationary due to the corresponding one-way clutch 121.

Figure 13:
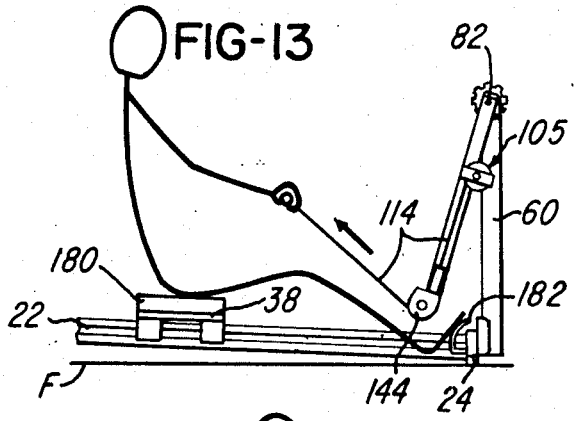
Figure 14:
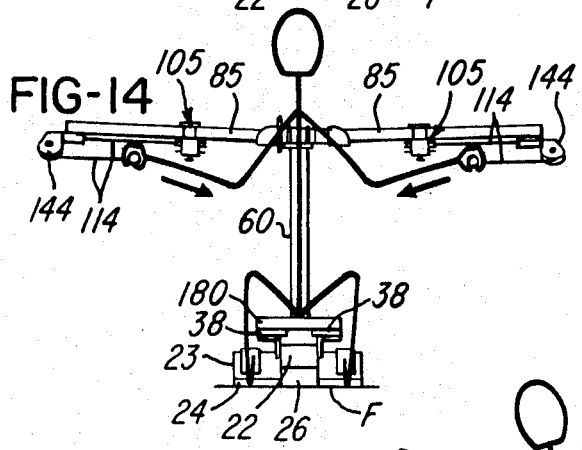
Figure 15:
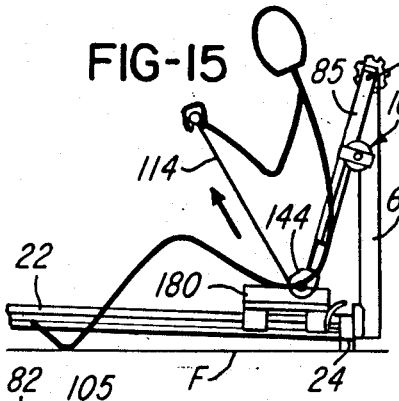
Figure 16:
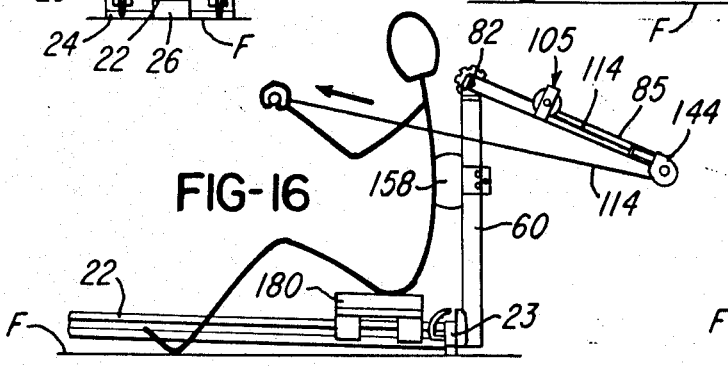
Figure 17:
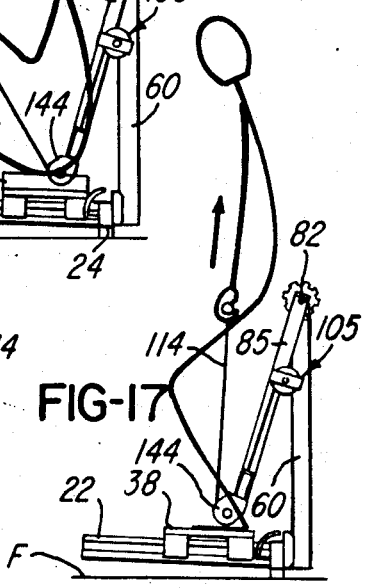

When it is desired to use the apparatus for a rowing exercise, as illustrated in FIG. 13, the pad 158 and column extender 164 are removed, and the arms 85 are rotated to a downwardly projecting position, as shown in FIG. 13, with the arms diverging laterally by a few degrees. The seat platform 180 is mounted on the foot platforms 38 with the brake pads 49 released so that the seat platform is free to move on the tracks 32. For the exercise shown in FIG. 15, the pad 158 is mounted directly on the column 60 and the seat platform 180 is mounted on the foot support platforms 38, but the carriages 35 are clamped to the frame 22 to prevent the seat platform 180 from moving on the frame. To perform the exercise shown in FIG. 17, the seat platform 180 may be removed, but the foot support carriages 35 are clamped to the base frame 22 to prevent movement of the foot support platforms 38. The arms 85 may also be positioned as illustrated in FIGS. 11, 12, 14 and 16 and in other positions to perform various other exercises after the pad 158 is attached directly to the column 60 and the seat platform 180 is attached to the clamped foot support carriages 35.

Figure 10:
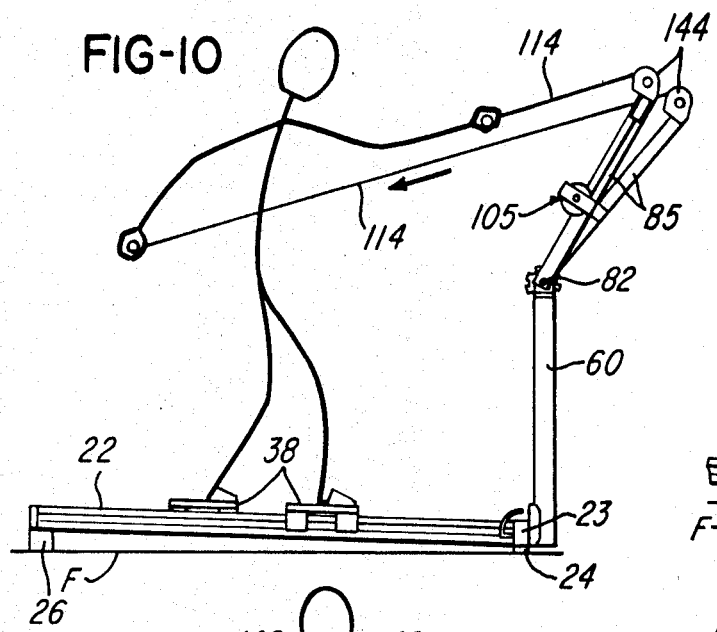
FIGS. 10–17 are stick figure drawings illustrating different uses for the exercising apparatus shown in FIGS. 1–9.
Figure 11:
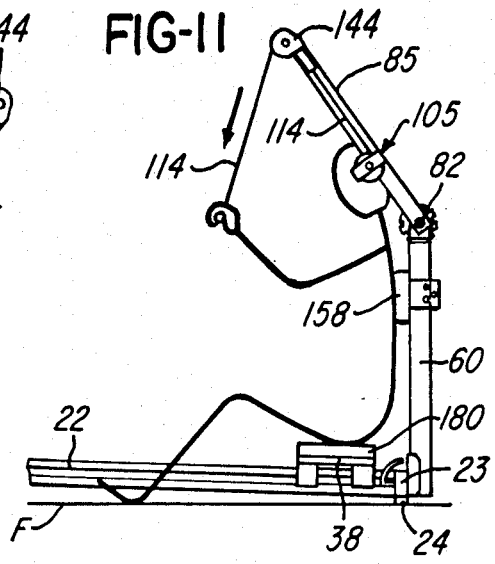
Figure 12:
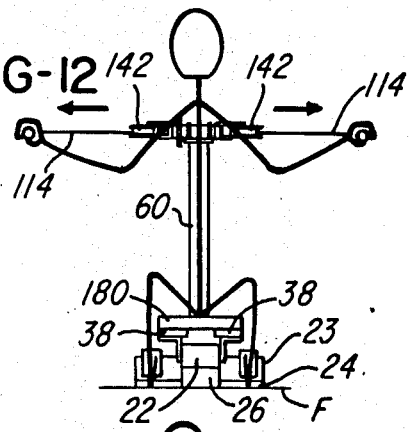

From the drawings and the above description, it is apparent that an exercising machine or apparatus constructed in accordance with the invention, provides desirable features and advantages. As a primary advantage, the apparatus provides for performing a substantial variety of different exercises. The brake adjusting knobs 54 and 137 may be precisely selected for the desired resistance to movement of the foot support carriages 35 and extension of the cables 114 by the handle grips 155. The apparatus may also be conveniently collapsed in a compact position for storage and shipping simply by removing the column extender 164 and pivoting the column 60 and arms 85 to positions generally parallel to the base frame 22. In this collapsed position, the entire apparatus or machine may be enclosed within a relatively small shipping box or storage space. The slight incline of the base frame 22 downwardly towards the column 60, is desirable when the apparatus is used as a cross-country ski exerciser, as shown in FIG. 10, or as a rowing machine, as shown in FIG. 13. If it is desired to provide a greater resistance to movement of each foot support carriage 35 in one direction relative to its opposite direction, this may be accomplished by using shiftable wedge-shaped brake pads in place of the pads 49 on the foot support carriages 35. Such one way increased resistance to movement of the foot support carriages 35 may also be accomplished by the use of a corresponding pair of spring retractable reel assemblies with one way clutches, similar to the reel assembly 105 described above.

While the form of exercising apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Apparatus for performing a variety of body exercises, comprising an elongated generally horizontal base frame having first and second end portions, a pair of foot support members, means mounted on said base frame and supporting said foot members for corresponding longitudinal movement along generally parallel spaced paths, a generally vertical column having a lower end portion and an upper end portion, means for securing said lower end portion of said column to said first end portion of said base frame, a pair of arms each having inner and outer end portions, means connecting said inner end portions of said arms to said upper end portion of said column and providing for substantial rotation of said arms about a generally horizontal axis and for substantial pivotal movement of each said arm about an axis transverse to said horizontal axis, means for locking said arms at different rotary and pivoted positions, a spring retractable reel operatively connected to each said arm and having a flexible cable with a free end portion, means for directing each said cable from said outer end portion of the corresponding said arm generally horizontally regardless of the position of said arm, a handle grip member connected to said free end portion of each said cable, and a one-way clutch and adjustable brake mechanism associated with each said reel to provide for selecting the force required to extend each said cable according to the selected exercise being conducted on said apparatus.

2. Apparatus as defined in claim 1 wherein said means connecting said arms to said column provide for rotating said arms as a unit on said horizontal axis.

3. Apparatus as defined in claim 1 wherein said means connecting said arms to said column provide for rotating said arms at least a substantial portion of 360°.

4. Apparatus as defined in claim 1 wherein said means connecting said arms to said column provide for pivoting each said arm through an angle of at least a substantial portion of 90°.

5. Apparatus as defined in claim 1 wherein said means for directing each said cable from said outer end portion of the corresponding said arm comprise a pulley supported for rotation and for pivotal movement on an axis generally parallel to said arm, and means securing each said reel to the corresponding said arm for pivotal movement with said arm.

6. Apparatus as defined in claim 1 and including a seat member for connecting said foot support members for movement as a unit and providing for using said apparatus as a rowing machine when said arms are in a downwardly projecting position from said upper end portion of said column.

7. Apparatus as defined in claim 1 and including adjustable brake means carried by each said foot support member and providing for changing the force required to move each said foot support member longitudinally along said base frame.

8. Apparatus as defined in claim 1 wherein each of said handle grip members has a V-shaped configuration with two gripping portions to provide for using said apparatus as a simulated cross-country skiing exerciser in addition to other exercisers.

9. Apparatus as defined in claim 1 and including a resilient pad member, and means mounted on said column for selectively supporting said pad member spaced substantially from said column for a simulated cross-country skiing exercise or directly adjacent said column for performing other exercises.

10. Apparatus as defined in claim 9 wherein said pad member is supported by a first U-shaped mounting bracket adapted to receive said column, an elongated column extender having a first end portion with a second U-shaped mounting bracket adapted to receive said column, said column extender having a second end portion adapted to receive said first mounting bracket, and releasable means for selectively securing said second mounting bracket to said column and said first mounting bracket to either said column or said second end portion of said column extender.

11. Apparatus as defined in claim 1 wherein said means securing said lower end portion of said column to said second end portion of said base frame, include a pivot pin and releasable lock means to provide for pivoting said column to a storage position generally parallel to said base frame.

12. Apparatus as defined in claim 1 wherein said base frame includes a pair of channel-like portions facing laterally in opposite directions, a carriage supported within each of said channel-like portions for longitudinal transversing movement and including a set of longitudinally spaced rollers, and means rigidly connecting each of said carriages to one of said foot support members.

13. Apparatus as defined in claim 12 wherein each of said carriages includes an adjustable brake pad engaging the corresponding channel-like portion of said base frame for selecting the force required for moving said carriage and foot support member along said base frame.

14. Apparatus for performing a variety of body exercises, comprising an elongated generally horizontal base frame having first and second end portions, a pair of foot support members, means mounted on said base frame and supporting said foot members for corresponding longitudinal movement along generally parallel spaced paths, a generally vertical column having a lower end portion and an upper end portion, means for securing said lower end portion of said column to said first end portion of said base frame, a pair of arms each having inner and outer end portions, means connecting said inner end portions of said arms to said upper end portion of said column, said connecting means providing for substantial rotation of said arms as a unit about a generally horizontal axis and through 360 degrees, said connecting means also providing for pivotal movement of each said arm about an axis transverse to said horizontal axis and through an angle of about 90 degrees, means for locking said arms at different rotary and pivoted positions, a spring retractable reel mounted on each said arm and having a flexible cable with a free end portion, a pulley mounted for swivel movement on said outer end portion of each said arm and directing said cable from the corresponding said reel, a handle grip member connected to said free end portion of each said cable, and a one-way clutch and adjustable brake mechansim connected to each said reel to provide for selecting the force required to extend each said cable according to the selected exercise being conducted on said apparatus.

15. Apparatus as defined in claim 14 and including a seat member fo connecting said foot support members for movement as a unit and providing for using said apparatus as a rowing machine when said arms are in a downwardly projecting position from said upper end portion of said column.

16. Apparatus as defined in claim 14 and including adjustable brake means carried by each said foot support member and providing for changing the force required to move each said foot support member longitudinally along said base frame.

17. Apparatus as defined in claim 14 wherein each of said handle grip members has a V-shaped configuration with two gripping portions to provide for using said apparatus as a simulated cross-country skiing exerciser in addition to other exercisers.

18. Apparatus as defined in claim 14 and including a resilient pad member, and means mounted on said column for selectively supporting said pad member spaced substantially from said column for a simulated cross-country skiing exercise or directly adjacent said column for performing other exercises.

19. Apparatus as defined in claim 14 and including an adjustable brake pad engaging said base frame for each of said foot support members for selecting the force required for moving said foot support member along said base frame.

20. Apparatus for performing a variety of body exercises, comprising an elongated generally horizontal base frame having first and second end portions, a pair of foot support members, means mounted on said base frame and supporting said foot members for corresponding longitudinal movement along generally parallel spaced paths, a generally vertical column having a lower end portion and an upper end portion, means for securing said lower end portion of said column to said first end portion of said base frame, a pair of arms each having inner and outer end portions, means connecting said inner end portions of said arms to said upper end portion of said column and providing for substantial rotation of said arms about a generally horizontal axis and for substantial pivotal movement of each said arm about an axis transverse to said horizontal axis, means for locking said arms at different rotary and pivoted positions, a spring retractable reel mounted on each said arm and having a flexible cable with a free end portion, a swivel pulley mounted on each said arm for directing the corresponding said cable from said arm generally horizontally regardless of the position of said arm, a handle grip member connected to said free end portion of each said cable, and an adjustable brake associated with each of said foot members to provide for selecting the force required to move said foot member according to the selected exercise being conducted on said apparatus.

* * * * *